US006029750A

United States Patent [19]

Carrier

[11] Patent Number: 6,029,750

[45] Date of Patent: Feb. 29, 2000

[54] ALL TERRAIN FIRE-FIGHTING VEHICLE

[76] Inventor: Brian E. Carrier, 461 Holiness Church, Wagener, S.C. 29164

[21] Appl. No.: 08/838,547

[22] Filed: Apr. 9, 1997

Related U.S. Application Data

[60] Provisional application No. 60/030,234, Nov. 8, 1996.

[51] Int. Cl.[7] ..... A62C 27/00

[52] U.S. Cl. ..... 169/52; 169/13; 169/15; 296/19

[58] Field of Search ..... 169/14, 15, 24, 169/52, 13; 296/19

[56] References Cited

U.S. PATENT DOCUMENTS

| | | | |
|---|---|---|---|
| 4,291,769 | 9/1981 | Müller | 169/13 |
| 4,593,855 | 6/1986 | Forsyth | 239/74 |
| 4,875,526 | 10/1989 | Latino et al. | 169/24 |
| 4,917,193 | 4/1990 | Ockler | 169/24 |
| 5,476,146 | 12/1995 | Brown | 169/24 |
| 5,573,300 | 11/1996 | Simmons | 296/19 X |

*Primary Examiner*—Andrew C. Pike

*Attorney, Agent, or Firm*—Michael A Mann; Nexsen Pruet Jacobs & Pollard LLP

[57] ABSTRACT

A vehicle for fighting fires in remote areas comprises an all terrain vehicle carrying a water-fillable tank, a water pump in fluid communication with the inside of the tank, an engine to operate the pump, and at least one hose for directing the pumped water, preferably foamed with a foaming agent at the fire.

15 Claims, 6 Drawing Sheets

24
34
10
14
38
12

22
22
16
42
18
48
14
20
38
10
46
40
50

18'
82
106
120
20'
112
38'
108
122
14'
64
62
60
12'
62
150
10'

124
14'
112
64
64
60
62
62
12'
10'

ALL TERRAIN FIRE-FIGHTING VEHICLE

The inventor claims the benefits of the priority date accorded provisional patent application Ser. No. 60/030,234, filed Nov. 8, 1996.

BACKGROUND OF THE INVENTION

1. Field of the Invention

The present invention relates to fire-fighting equipment. More specifically, the present invention is a vehicle equipped to fight fires in remote areas or areas not accessible by paved roads.

2. Discussion of Background

Not all fires that threaten life and property occur in urban areas where roads lead to a convenient spot for deploying fire-fighting equlipment and tapping into a municipal water supply. Fires often occur in remote, rugged areas where water for dousing the fire might be in short supply. To make matters worse, because many of these areas are covered with vegetation and trees, there will be no shortage of fuel for the fire. Consequently, some of the most destructive fires—forest fires and brush fires—occur or begin in remote areas.

These fires are fought in a variety of ways, usually by attempting to remove fuel from the fire's path with earth-moving equipment or by dousing the fire with water or fire retardant carried by transport planes or helicopters. Establishing a fire break takes time; sometimes the fire must be extinguished or at least controlled until a fire break can be established. Under these circumstances, fires are fought by individuals on foot carrying tanks of water on their backs. Water, of course, cools the fuel below its ignition temperature. By adding a foaming agent to the water, the resulting foam suffocates the fire and makes better use of the water. However, it may require a large number of tanks and many trips on foot over rugged ground to secure control over a fire.

There remains a need for a more effective way to control fires in remote areas.

In addition, many public safety departments, including fire and police departments, conduct search and rescue operations in areas that are not conducive to automotive traffic. In such instances, it may not be possible to transport equipment or rescue personnel to specific locations because of the terrain. In the past, the equipment had to be carried by the individual search and rescue personnel and then any injured person carried out by them. Consequently, there is a need for a more effective way to transport equipment and personnel over areas having difficult terrain and for transporting injured persons. In addition, there is need for a single device or apparatus that can solve all of the above problems.

SUMMARY OF THE INVENTION

According to its major aspects, the present invention is an all terrain vehicle equipped to fight fires. The vehicle is lightweight and stable when traveling over rough ground; and it carries a relatively large capacity tank of water, preferably 100 gallons or more, and the corresponding equipment to foam that water and direct the foam at a fire.

The combination of an all terrain vehicle, a tank of water, and fire-fighting equipment is an important feature of the present invention. This combination uses the ability of the vehicle to carry more water than an individual on foot can carry and to cover difficult terrain relatively quickly. As a result, firefighters using the present vehicle can bring more water to bear on a fire and more quiclkly than a much larger team of firefighters on foot. Furthermore, the use of the vehicle can allow firefighters to target the foamed water better than when larger quantities of water are dropped by aircraft.

This combination also has several important advantages, such as the ability to transport a pump or other device to direct the water or foam at the fire. For example, the pump can force the water and foam through the hose at a higher velocity, thus allowing the firefighters to attack the fire from a greater distance than if they were on foot. Furthermore, while it is not practical for a firefighter or group of firefighters to carry a water cannon and then hold and operate it by hand, the present invention does permit the transportation of the water cannon, thus enablling the firefighters to attack the fire from an even greater distance.

Another important feature of the present invention is that the tank, hoses, and pump may be readily removed from the vehicle through the use of quick-release devices. Assuming the water and foam tanks are empty, four firefighters should easily be able to remove the fire-fighting equipment, which would enable the vehicle to be used during a search and rescue. The back portion, or rear deck, of the vehicle is capable of carrying two injured persons while two emergency personnel ride in the vehiicle's passenger area. Consequently, transforming the vehicle and enabling it to be used for a different purpose reduces the number of vehicles required and provides greater flexibility to the firefighters or other emergency personnel who use the device.

The use of a pump mounted to the all terrain vehicle which is capable of pumping water from a lake or stream onto a fire is another feature of the present invention. This features reduces the need to transport water to the site of the fire or, in the alternative, makes it easier to transport water pumping equipment to the body of water to be used in fighting the fire.

Providing means for refilling the tank while pumping water from a body of water onto a fire is still another feature of the present invention. A water source can thus be used for two purposes simultaneously, which gives the present invention more flexibility in attacking fires.

Other features and their advantages will be apparent to those skilled in fire-fighting equipment from a careful reading of the Detailed Description of Preferred Embodiments accompanied by the following Drawings.

DETAILED DESCRIPTION OF PREFERRED EMBODIMENTS

Figure 1:
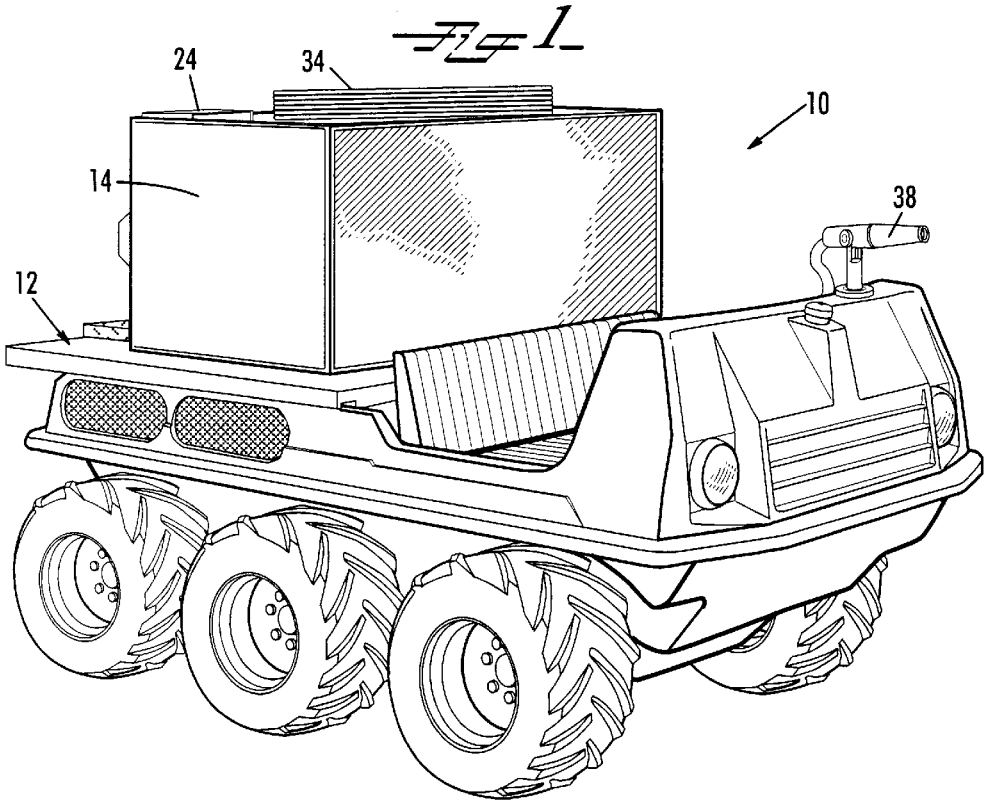
FIG. 1 is a perspective view of a vehicle according to a preferred embodiment of the present invention.
Figure 2:
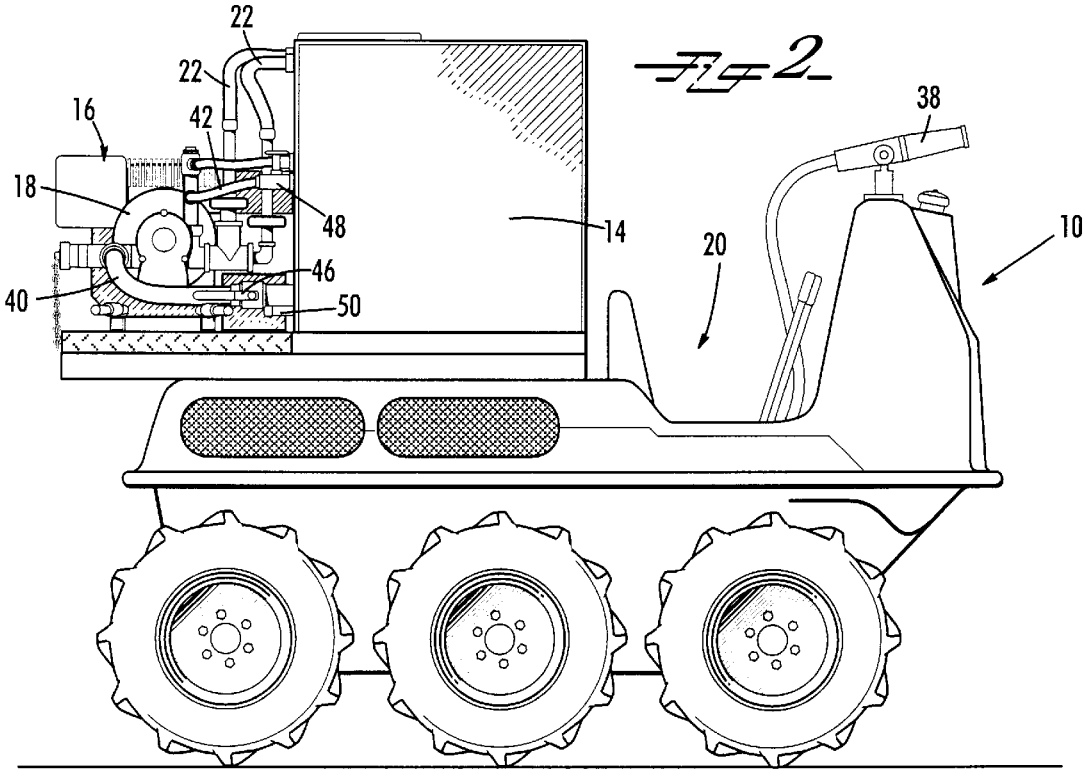
FIG. 2 is a side view of a vehicle according to a preferred embodiment of the present invention.
Figure 3:
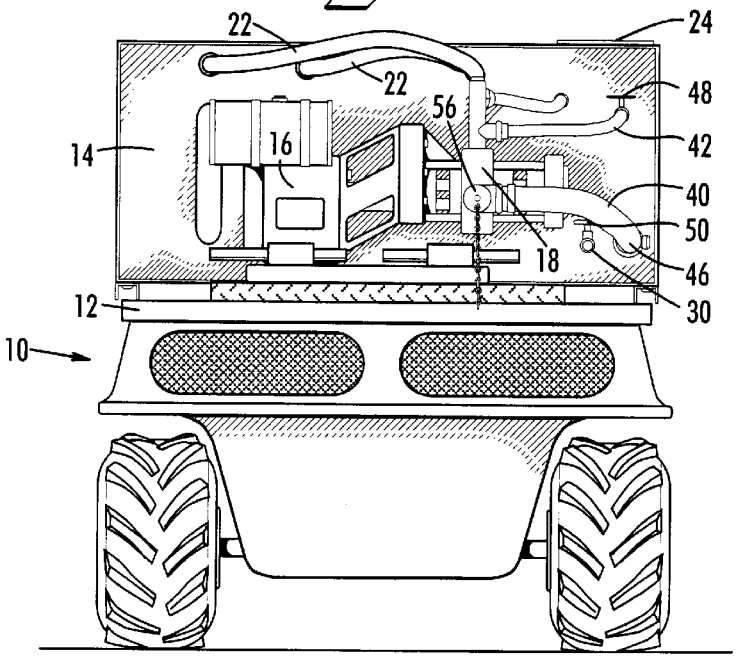
FIG. 3 is a rear view of a vehicle according to a preferred embodiment of the present invention.
Figure 4:
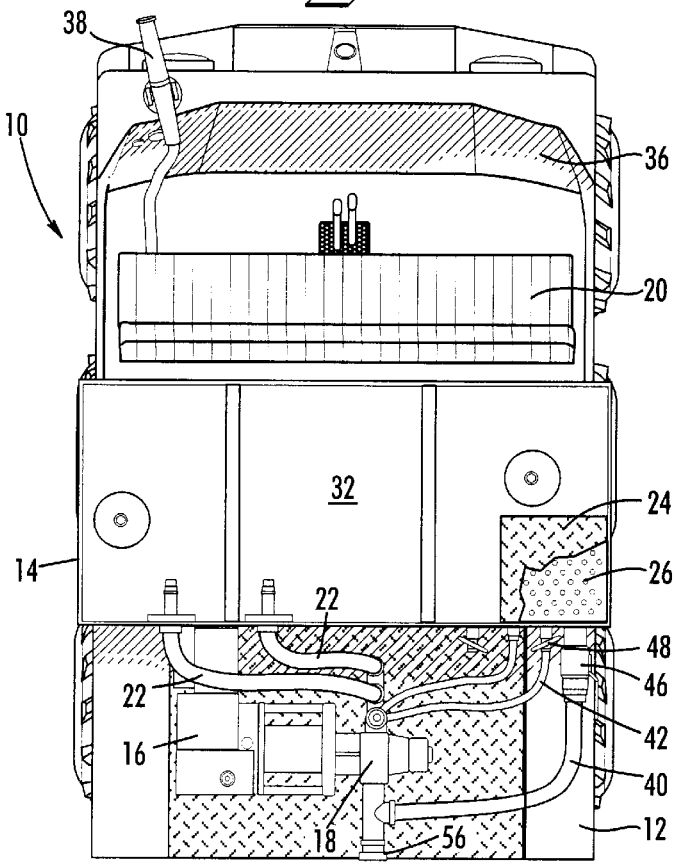
FIG. 4 is a top view of a vehicle according to a preferred embodiment of the present invention.
Figure 5:
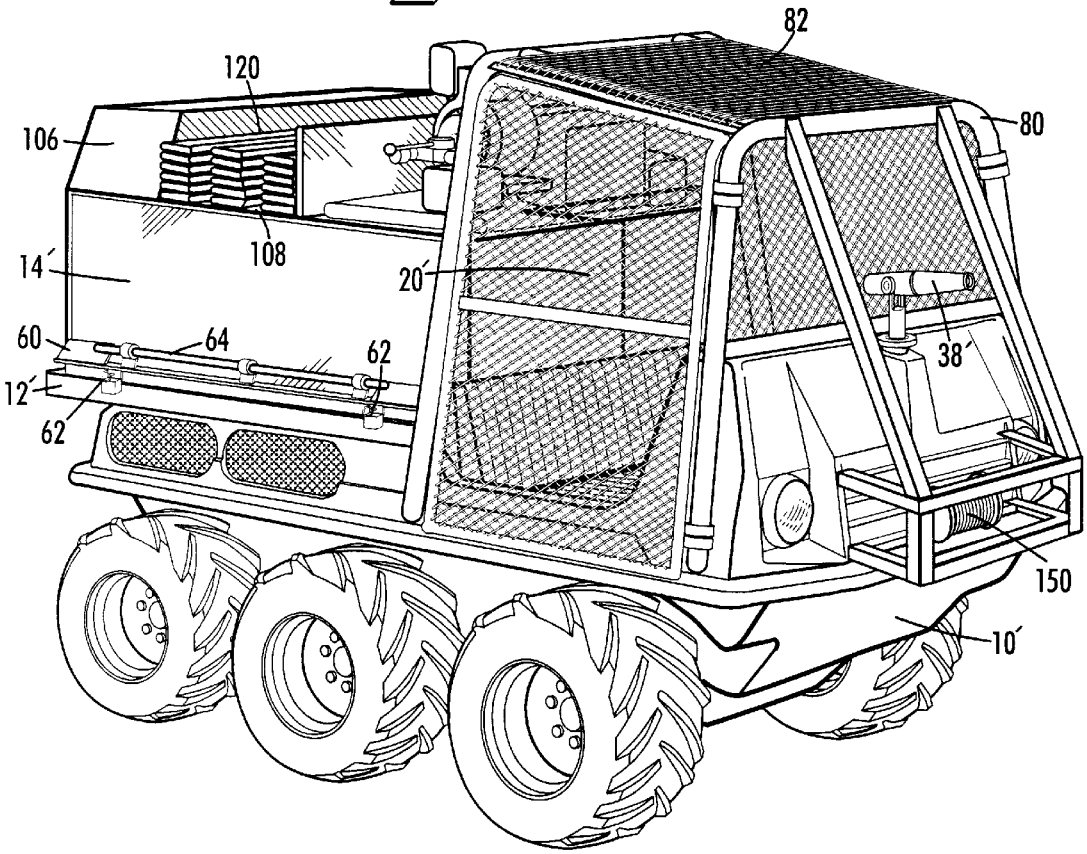
FIG. 5 is a perspective view of a vehicle according to another preferred embodiment of the present invention.

The present invention is a vehicle equipped and designed for fighting fires in remote areas. The vehicle is designed to cover rough terrain with a large tank of water and to allow its operator to direct foamed water from that tank at a fire.

Referring now to the figures, there is shown a vehicle 10 according to a preferred embodiment of the present invention. Vehicle 10 is the type that is generally referred to as an "all terrain vehicle". Specifically, it is designed to be drivable on uneven ground, on mud, through deep water, or on other surfaces a regular automobile or truck cannot be driven on. To achieve this effect, the vehicle is relatively lightweight, has six-wheel drive, is sealed against water intrusion to critical engine and transmission parts, and is chain driven and geared for low speeds and power. Weight reduction is achieved by using a polyethylene body. The tires are formed to provide traction on slippery ground and to paddle the vehicle forward on water. Alternatively, the vehicle may move using tank treads made of synthetic or natural rubber. Suitable basic all terrain vehicles are manufactured by Recreative Industries, Inc. and sold under the trademark BUFFALO, and by Argo, Inc. and sold under the trademark VANGUARD.

The fire-fighting equipment for the vehicle 10 is preferably carried by a frame 60 which supports a tank 14, engine 16, and pump 18. Vehicle 10 is typically outfitted with a rear deck 12 behind a passenger area 20 which is adapted to support frame 60 carrying tank 14, engine 16, and pump 18. Frame 60 is attached to rear deck 12 of vehicle 10 so that it may be easily and quickly removed if necessary. In a preferred embodiment, as shown in FIGS. 5–8, frame 60 is attached to rear deck 12' by four pins 62 located on the corners of frame 60. Pins 62 engage rear deck 12' and frame 60, thus securing tank 14', pump 18' and engine 16' to vehicle 10'; however, pins 62 may be removed from this connection so that frame 60 may be removed from rear deck 12'. Once pins 62 are removed and any other connections are severed, four firefighters should be able to easily remove frame 60 from rear deck 12', assuming tank 14' is empty. In addition, handrails 64 may be provided to facilitate the removal of the fire-fighting equipment.

Figure 11:
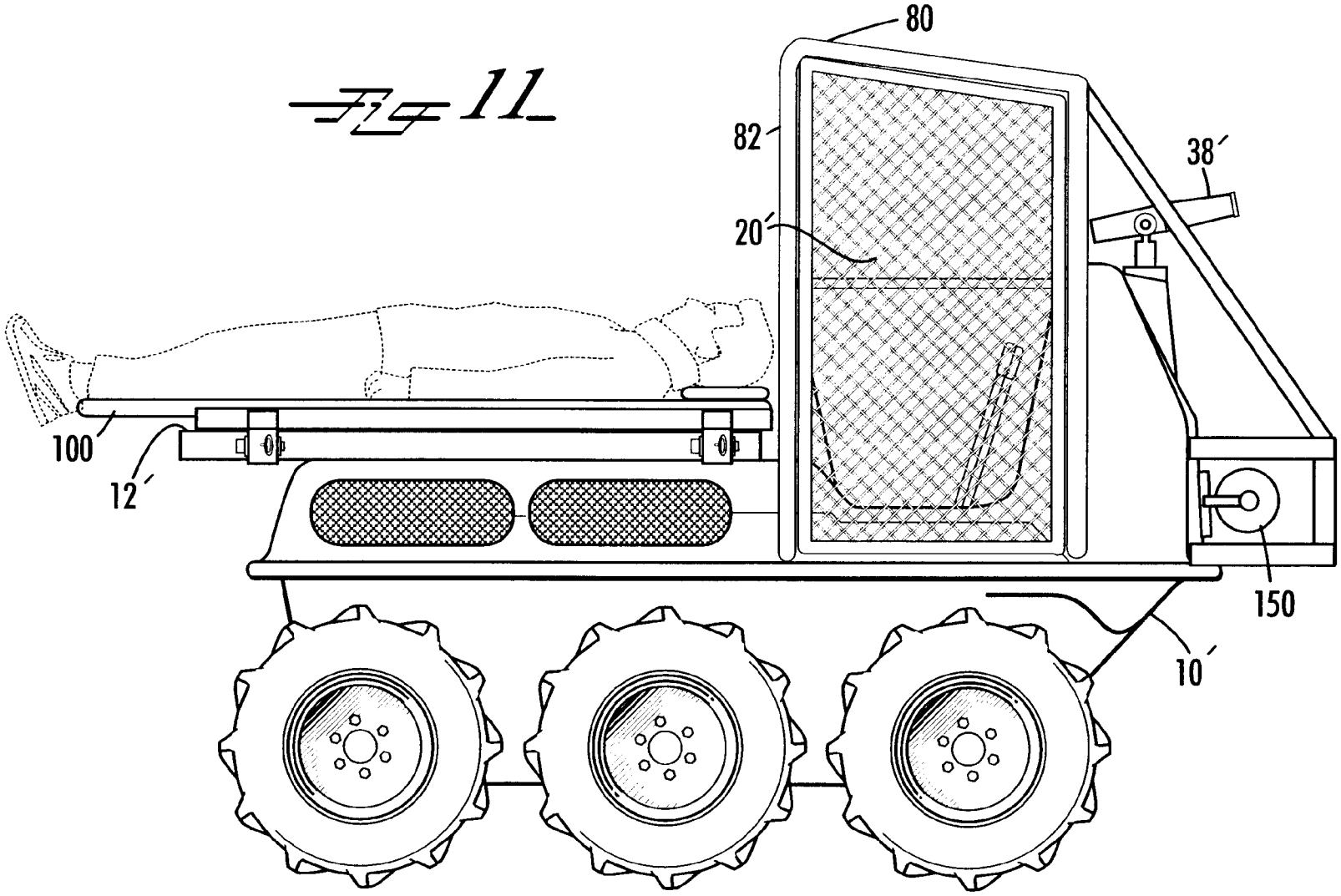
FIG. 11 is a side view of a vehicle with a stretcher replacing its fire-fighting equipment, according to a preferred embodiment of the present invention.

As shown in FIG. 11, rear deck 12' of vehicle 10' is also designed to support at least one stretcher 100 and preferably two, once frame 60 has been removed. By removing frame 60 and the fire-fighting equipment, vehicle 10' is able to be used as a search and rescue vehicle, transporting two injured persons by stretcher 100 and two emergency personnel over rough terrain or through water, or anywhere vehicle 10' is able to travel. Therefore, vehicle 10' is able to be transformed and adapted to suit a specific need for a given public safety department, either fighting fires or assisting in the other search and rescue operations that are invariably undertaken by all fire and police departments.

Figure 10:
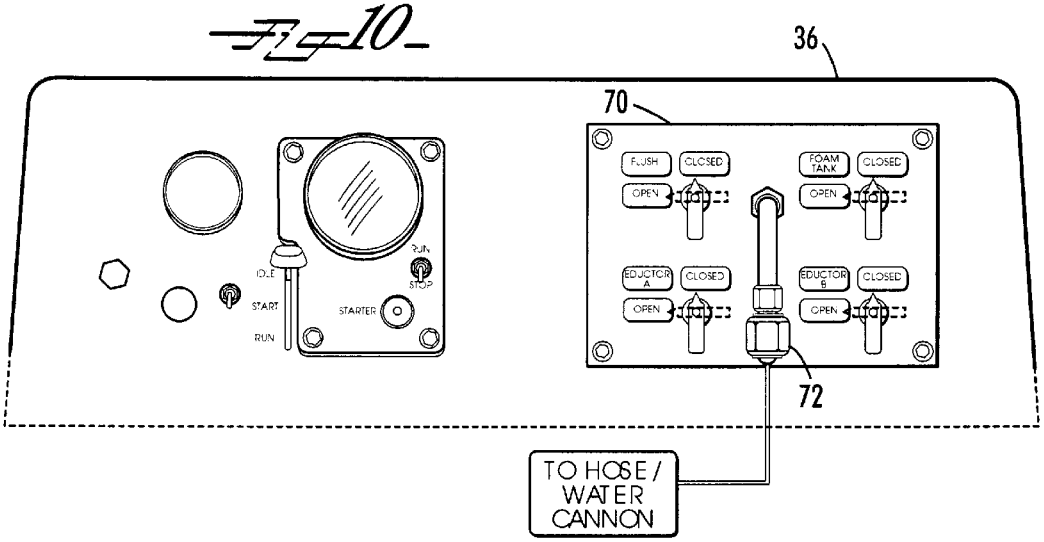
FIG. 10 is a front view of the dash of a vehicle according to another preferred embodiment of the present invention.

Engine 16', which may be fueled by any number of fuels Such as gasoline, diesel, propane, or natural gas, is preferably separate from the one used to power vehicle 10', but may be the same engine by using a suitable coupling. However, engine 16' needs to provide enough power to enable pump 18' to shoot sufficient volumes of water or foam toward a fire from a distance that will not endanger the operator of vehicle 10'. An eleven-horsepower, four cycle, air-cooled engine will provide such power when coupled to a five horsepower pump. Engine 16' is preferably of the type that is quick and easy to start, such as one equipped with electronic ignition, and is preferably able to be started from the interior of the passenger area 20' of vehicle 10', as shown in FIG. 10.

As shown in a preferred embodiment and FIGS. 1–4, tank 14 is preferably sized to hold 100 gallons and most preferably sized to hold 200 gallons, and may have a water level indicator built into it or a separate water level gauge. Ideally, tank 14 will be sized as large as can be easily accommodated by vehicle 10 in terms of size and weight. The shape of tank 14 is not critical; however, ideally it will have a center of gravity as low as possible for stability. With appropriate reinforcing, engine 16 and pump 18 can be mounted on top of tank 14.

Tank 14 may have a recessed top for storage of hoses 22, preferably two 100-foot hoses, and has a large fill orifice 24, preferably fitted with screen 26 to filter debris that would otherwise clog hoses 22 or pump 18 in case tank 14 is refilled from lakes, ponds, or streams. Additionally, tank 14 requires a master drain 30 for flushing and cleaning the tank and can provide water as a coolant for pump 18.

Hoses 22 can run from pump 18 to a recess 32 in the top of tank 14 where additional hoses 34 can be stored for use. Alternatively, one hose can be fed to the dashboard 36 to a water cannon 38 for use directly by the operator. In additions a water cannon 38 may be provided with vehicle 10 and located on dashboard 36 of vehicle 10 so that a driver can direct a stream of foamed water at the fire without getting out of vehicle 10 and, indeed, perhaps while driving.

A foaming agent can be dispensed from a container (not shown in FIGS. 1–4) inside tank 14 that adds foamant to the water in tank 14. Enough foamant of any suitable commercially available, fire-retarding chemical foamants should be provided to foam all the water in tank 14, so that 100 gallons of water will produce approximately 10,000 gallons of foam when the water is discharged through a standard eductor jet nozzle attached to the end of hoses 22. This foaming system may be controlled by a series of valves as described below, or may be controlled from a control panel 70 within the confines of passenger area 20' of vehicle 10', as shown in FIG. 10. Control panel 70, while including the necessary valves to activate the foaming system or just water, also comprises an adjustable valve 72 which enables the thickness of the foam expelled through the hoses or water cannon 38' to be changed between a heavy and light foam.

For controlling the flow of water in the embodiment of FIGS. 1–4, a series of valves and hoses are used. A first valve 46 controls the flow of water through a first hose 40 from tank 14 to pump 18; a second valve 48 controls the flow of the water from a second hose 42 through the tank filter; and a third valve 50 prevents water from flowing from master drain 30. If there is a convenient nearby source of water, such as a lake or stream, the water from it can be pumped directly by pump 18 onto the fire by hoses 22 by removing an endcap 56 from pump 18.

Another preferred embodiment of the present invention and arrangement of fire-fighting equipment is shown in FIGS. 5–8. As stated above, the fire-fighting equipment is secured to frame 60, which is removably secured to rear deck 12' of vehicle 10'. In addition, passenger area 20' of vehicle 10' is enclosed by roll bars 80 and a wire mesh or steel grate is 82, so that its passengers are protected from debris and other potential hazards.

Figure 6:
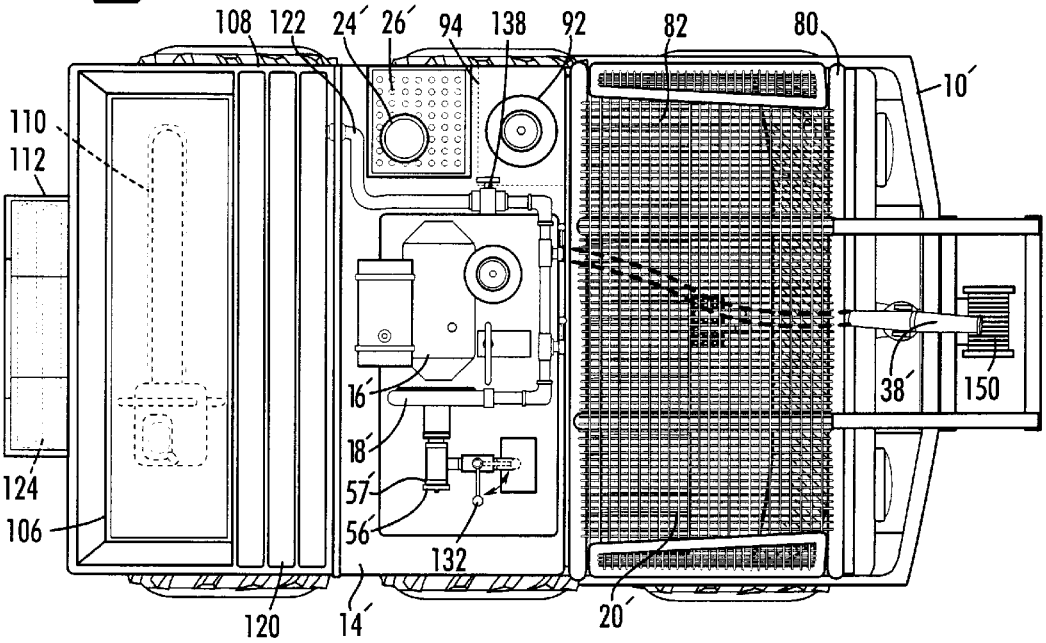
FIG. 6 is a top view of a vehicle according to the preferred embodiment of FIG. 5.
Figure 7:
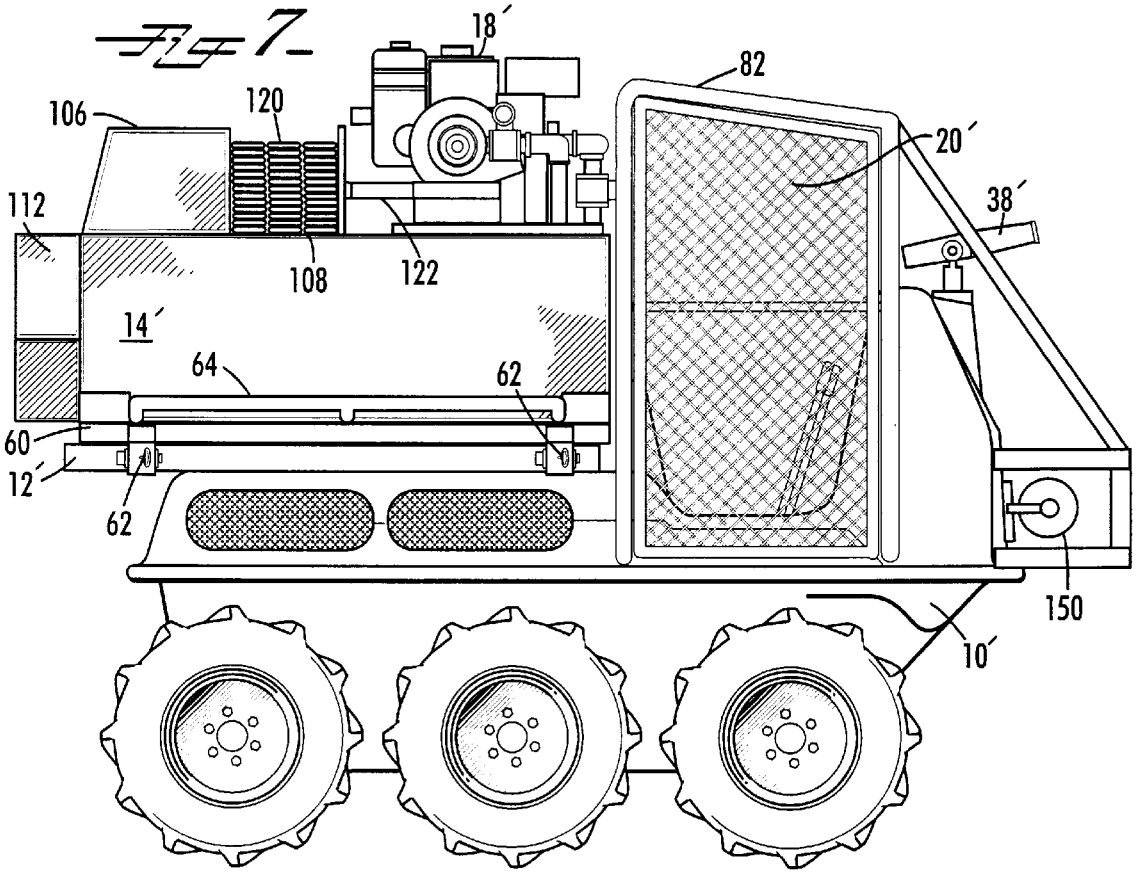
FIG. 7 is a side view of a vehicle according to the preferred embodiment of FIG. 5.
Figure 8:
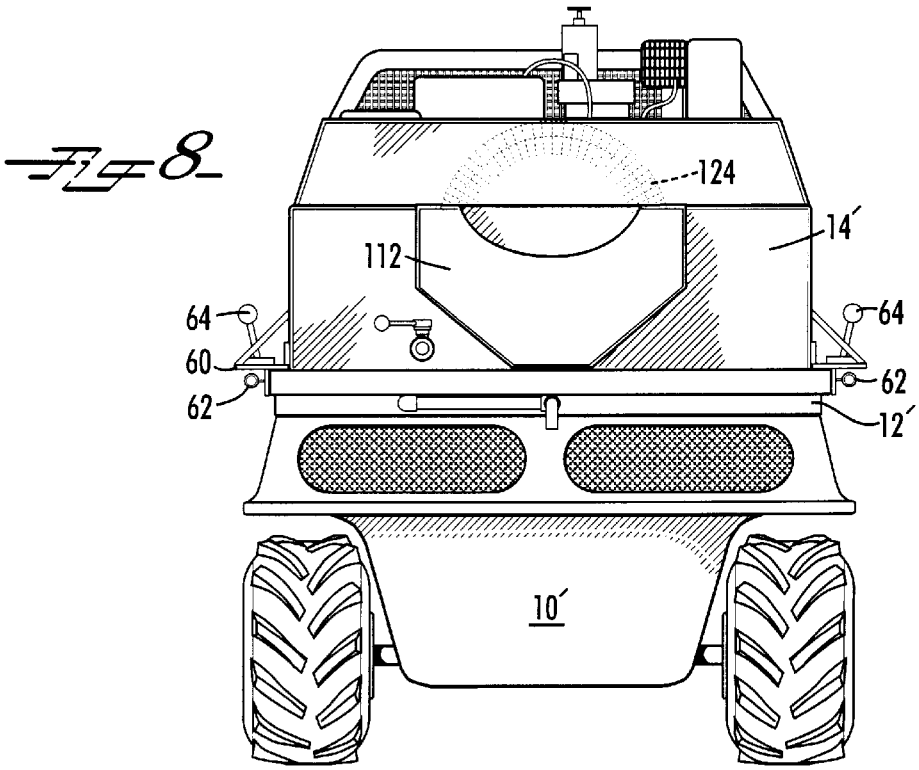
FIG. 8 is a rear view of a vehicle according to the preferred embodiment of FIG. 5.
Figure 9:
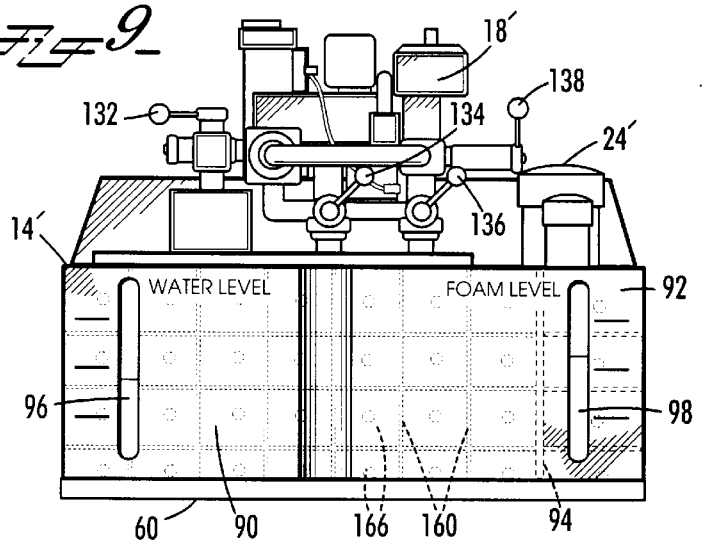
FIG. 9 is a front view of the tank and pump of a vehicle according to the preferred embodiment of FIG. 5.

In this embodiment, tank 14' has a first compartment 90 and a second compartment 92 separated by a divider 94, as shown in FIGS. 6 and 9. First compartment 90 preferably contains at least 150 gallons of water, while second compartment 92 contains approximately 5 gallons of a foaming agent like that described above. Tank 14' is also preferably divided by a plurality of sections 160 having a number of holes 166 dispersed therein. Sections 160 and holes 166 permit fluid to flow within tank 14', but prevents the fluid from shifting or "sloshing" from one side to the other. It is important for the fluid not to shift, since the center of gravity of vehicle 10' would shift with the fluid, which would in turn increase the chance of vehicle 10' overturning.

In addition, pump 14' which includes a self-contained engine 16' and which is fueled from the same fuel tank that supplies vehicle 10', is positioned on top of tank 14'. Also positioned along the top of tank 14' are two storage areas. The first storage area 106 is enclosed and is designed to carry equipment, such as chain saws 110, axes or other fire-fighting equipment. The second storage area 108 serves as a hose bed enabling a length of hose to be folded upon itself and stored when vehicle 10' is traveling.

As shown in FIGS. 5–8, a fire hose 120 is provided in second storage area 108 and is fluidly attached to pump 18' by conduit 122. A Suction lose 124 which is normally carried in a rear storage area 112 is also provided which can be connected to pump 18'. An adjustable valve system is also provided which controls the direction of flow of water and foam through fire hose 120 and suction hose 124. In FIG. 9, the valve system includes a tank valve 132 which controls fluid flow between first compartment 90 of tank 14' and pump 18'; a tank fill valve 134 to which suction hose 124 may be attached for refilling first compartment 90 of tank 14' when pump 18' is activated; a water cannon valve 136 that permits fluid to flow through water cannon 38'; and a master valve 138 which controls the flow of fluid through fire hose 120. However, in the preferred embodiment and as shown on control panel 70 of FIG. 10, these controls are preferably within passenger area 20'. Also shown in FIG. 9 of the present invention are sight levels 96, 98 indicating the level of fluid in first compartment 90 and second compartment 92, respectively.

In use, the valve system controls through which hose, fire hose 120 or water cannon 38', water or foam is expelled. While tank 14' may be filled through fill orifice 24' from a convenient source of water, tank 14' of vehicle 10' may also be filled from another source of water such as a stream or lake. Once at the stream or lake, suction hose 124 is submersed within the source of water,preferably fitted with a screen 26' to filter debris, pump 18' is activated, and the valve system is adjusted so that water travels from the source through suction hose 124 into pump 18' by removing end cap 56' from pump 18' and attaching suction hose 124 at 57. Then pump 18 can pump water from the source to water cannon 38' and hose 120 while refilling tank 14' as long as valves 136, 138 and 134, respectively, are opened. Once within pump 18', water from the source may be redirected through fire hose 120, water cannon 38', or mixed with the foaming agent. In addition, the water may be redirected to refill tank 14' or may be used to refill tank 14' while at the same time being expelled through fire hose 120 and water cannon 38'.

Preferably a two-man team is used with vehicle 10', one to operate vehicle 10' and one to operate hoses 22'. Having a separate engine 16' for pump 18' makes it possible to maneuver vehicle 10' while directing foamed water at the fire; however, this may also be possible with a single engine. Having water cannon 38' mounted on the front of vehicle 10' makes it possible for the driver to direct a stream of foamed water simultaneously with the other team member, who may be using the hose a hundred feet away.

It will be apparent to those skilled in the art of fighting fires in remote areas that many modifications and substitutions can be made to the preferred embodiments described above without departing from the spirit and scope of the present invention. For example, vehicle 10' may also be provided with a winch 150 or other equipment that will aid the vehicle in its fire-fighting mission or during a search and rescue.

What is claimed is:

1. An apparatus for fighting fires, said apparatus comprising:

an all-terrain vehicle;

a tank carried by said all-terrain vehicle and having an interior, said tank being adapted to hold a quantity of water in said interior of said tank;

a pump carried on said tank and being in fluid communication with said interior of said tank so that said pump can pump the water into and out of said tank;

an engine carried on said tank for operating said pump;

a fire hose carried by said vehicle and being in fluid communication with said pump;

a water cannon carried by said vehicle and being influid communication with said pump;

a suction hose carried by said vehicle and in fluid communication with said pump so that said pump can pump the water into said tank and through said fire hose and said water cannon; and valve means for directing the water from said pump and into and out of said tank and through said fire hose and said water cannon, said valve means being adapted to direct the water through said fire hose and said water cannon simultaneously and individually.

2. The apparatus as recited in claim 1, wherein said all-terrain vehicle has a passenger area dimensioned to carry two people.

3. The apparatus as recited in claim 1, wherein said all-terrain vehicle has a passenger area enclosed in expanded metal to protect occupants of said passenger area.

4. The apparatus as recited in claim 1, wherein said apparatus further comprises a frame attached to said all-terrain vehicle.

5. The apparatus as recited in claim 4, wherein said frame has handrails attached thereto to facilitate lifting said frame, said pumps and said engine from said vehicle.

6. The apparatus as recited in claim 4, wherein said frame is attached to said all-terrain vehicle with removable pins to facilitate disconnecting said frame from said vehicle.

7. The apparatus as recited in claim 1, wherein said all-terrain vehicle has a passenger area, and wherein said engine and said pump are started from said passenger area.

8. The apparatus as recited in claim 1, wherein said tank has a fill orifice, said fill orifice having a screen for filtering debris when said tank is refilled.

9. The apparatus as recited in claim 1, wherein said tank has a plurality of sections in said interior, each section of said plurality of sections having a hole formed therein.

10. The apparatus as recited in claim 1, wherein said tank is formed to provide a storage area for said fire hose.

11. An apparatus for fighting fires, said apparatus comprising:

an all-terrain vehicle having a passenger area dimensioned for holding two passengers;

a tank carried by said all-terrain vehicle and having an interior, said tank being adapted for holding a quantity of water in said interior;

a pump carried by said vehicle and in fluid communication with said interior of said tank so that said pump can pump the water into and out of said tank;

an engine carried by said vehicle solely for operating said pump;

a fire hose carried by said vehicle and in fluid communication with said pump;

a water cannon carried by said vehicle, controlled from said passenger area, and being in fluid communication with said plump;

a suction hose carried by said vehicle and adapted to be placed in fluid communication with said pump so that said pump can pump the water into said tank and through said fire hose and said water cannon; and valve means controllable from said passenger area for directing the water from said pump as well as into and out of said tank and through said fire hose and said water cannon, said valve means being adapted to pump the water through said fire hose and said water cannon simultaneously and individually.

12. The apparatus as recited in claim 11, wherein said passenger area is enclosed in metal mesh to protect said passenger of said passenger area.

13. The apparatus as recited in claim 11, wherein said apparatus further comprises a frame adapted to be removably attachable to said all-terrain vehicle.

14. The apparatus as recited in claim 13, wherein said frame has handrails to facilitate lifting said frame, said pump, and said engine from said apparatus.

15. The apparatus as recited in claim 11, wherein said tank has means for limiting sloshing of the water in the interior of said tank.

* * * * *